US008322977B2

(12) United States Patent
Beeck

(10) Patent No.: US 8,322,977 B2
(45) Date of Patent: Dec. 4, 2012

(54) SEAL STRUCTURE FOR PREVENTING LEAKAGE OF GASES ACROSS A GAP BETWEEN TWO COMPONENTS IN A TURBINE ENGINE

(75) Inventor: Alexander R. Beeck, Orlando, FL (US)

(73) Assignee: Siemens Energy, Inc., Orlando, FL (US)

( * ) Notice: Subject to any disclaimer, the term of this patent is extended or adjusted under 35 U.S.C. 154(b) by 736 days.

(21) Appl. No.: 12/507,203

(22) Filed: Jul. 22, 2009

(65) Prior Publication Data

US 2011/0020113 A1 Jan. 27, 2011

(51) Int. Cl.
*F01D 11/12* (2006.01)

(52) U.S. Cl. ..... 415/139

(58) Field of Classification Search ..... 415/134, 415/139, 135, 174.2, 173.3; 416/193 A
See application file for complete search history.

(56) References Cited

U.S. PATENT DOCUMENTS

| | | | | |
|---|---|---|---|---|
| 4,492,737 | A * | 1/1985 | Conolly | 428/552 |
| 5,823,741 | A | 10/1998 | Predmore et al. | |
| 5,865,600 | A | 2/1999 | Mori et al. | |
| 5,868,398 | A | 2/1999 | Maier et al. | |
| 5,934,687 | A | 8/1999 | Bagepalli et al. | |
| 5,975,844 | A | 11/1999 | Milazar et al. | |
| 6,086,329 | A | 7/2000 | Tomita et al. | |
| 6,312,218 | B1 | 11/2001 | Beeck et al. | |
| 6,431,825 | B1 | 8/2002 | McLean | |
| 6,733,234 | B2 | 5/2004 | Paprotna et al. | |
| 6,883,807 | B2 | 4/2005 | Smed | |
| 7,152,864 | B2 | 12/2006 | Amos et al. | |
| 7,316,402 | B2 | 1/2008 | Paauwe | |
| 7,334,800 | B2 | 2/2008 | Minnich | |
| 2001/0019695 | A1 | 9/2001 | Correia | |
| 2007/0020102 | A1 | 1/2007 | Beeck et al. | |
| 2009/0053037 | A1 | 2/2009 | Marini et al. | |
| 2009/0148279 | A1 | 6/2009 | Shaefer et al. | |

FOREIGN PATENT DOCUMENTS

JP 11062502 A * 3/1999

OTHER PUBLICATIONS

JP 11-062502 A Machine Translation. May 10, 2012. 4 Pages.*

* cited by examiner

*Primary Examiner* — Richard Edgar

(57) ABSTRACT

A seal structure is provided for preventing leakage of gases across a gap between first and second components in a turbine engine. The seal structure is adapted to be received in first and second adjacent slots provided in the first and second components. The seal structure may comprise: a wear resistant layer; and a deformable layer defined by a material having one of a varying density and a varying porosity.

17 Claims, 3 Drawing Sheets

SEAL STRUCTURE FOR PREVENTING LEAKAGE OF GASES ACROSS A GAP BETWEEN TWO COMPONENTS IN A TURBINE ENGINE

FIELD OF THE INVENTION

The present invention relates to seal structure for preventing leakage of gases across a gap between first and second components in a turbine engine.

BACKGROUND OF THE INVENTION

U.S. Pat. No. 5,934,687 discloses a gas-path leakage seal for sealing a gap between first and second members of a gas turbine. The seal comprises a flexible metal sheet assembly, and first and second cloth layer assemblies.

U.S. Pat. No. 6,733,234 discloses a gas-path leakage seal assembly for sealing a gap between turbine members comprising a shim and a spring for urging the shim into contact with the turbine members. The shim may comprise a protection material for contacting the turbine components.

SUMMARY OF THE INVENTION

In accordance with a first aspect of the present invention, a seal structure is provided for preventing leakage of gases across a gap between first and second components in a turbine engine. The seal structure is adapted to be received in first and second slots provided in the first and second components. The seal structure may comprise: a wear resistant layer; and a deformable layer defined by a material having one of a varying density and a varying porosity.

The seal structure may further comprise a core layer positioned between the wear resistant layer and the deformable layer. The core layer may comprise a metal core layer.

The wear resistant layer may be formed from one of a metal powder and a ceramic powder. Preferably, the wear resistant layer is slightly harder than the first and second turbine engine components.

The deformable layer may be formed from one of a metal powder and a ceramic powder. Preferably, the deformable layer is softer than the first and second turbine engine components.

The deformable layer includes an outer surface and an inner surface and may comprise a density which increases from the outer surface to the inner surface.

The deformable layer includes an outer surface and an inner surface and may comprise a porosity which decreases from the outer surface to the inner surface.

In accordance with a second aspect of the present invention, a turbine engine is provided comprising a first component having a first slot; a second component having a second slot; and a seal structure. The second component is positioned adjacent to the first component such that the first and second slots are positioned generally opposed to one another. The seal structure is provided in the first and second slots for preventing leakage of gases across a gap between the first and second components. The seal structure comprises a wear resistant layer, and a deformable layer defined by a material having one of a varying density and a varying porosity. The seal structure may further comprise a core layer positioned between the wear resistant layer and the deformable layer.

The first slot may be defined by first and second inner surfaces of the first component and the second slot may be defined by third and fourth inner surfaces of the second component. The second and fourth inner surfaces may have surface imperfections.

The second and fourth surfaces may have a surface roughness Ra falling within a range of from about 0.8 micrometers to about 12.5 micrometers.

The deformable layer may contact the second and fourth inner surfaces of the first and second components and permanently deform during operation of the engine so as to correspond in shape to the surface imperfections on the second and fourth inner surfaces.

The deformable layer may be exposed to hot working gases and the wear resistant layer may be exposed to cooling gases. The cooling gases may have a pressure greater than that of the hot working gases.

DETAILED DESCRIPTION OF THE INVENTION

The embodiments of the present invention provide a gas-path leakage seal structure for use in a turbine engine.

Figure 1:
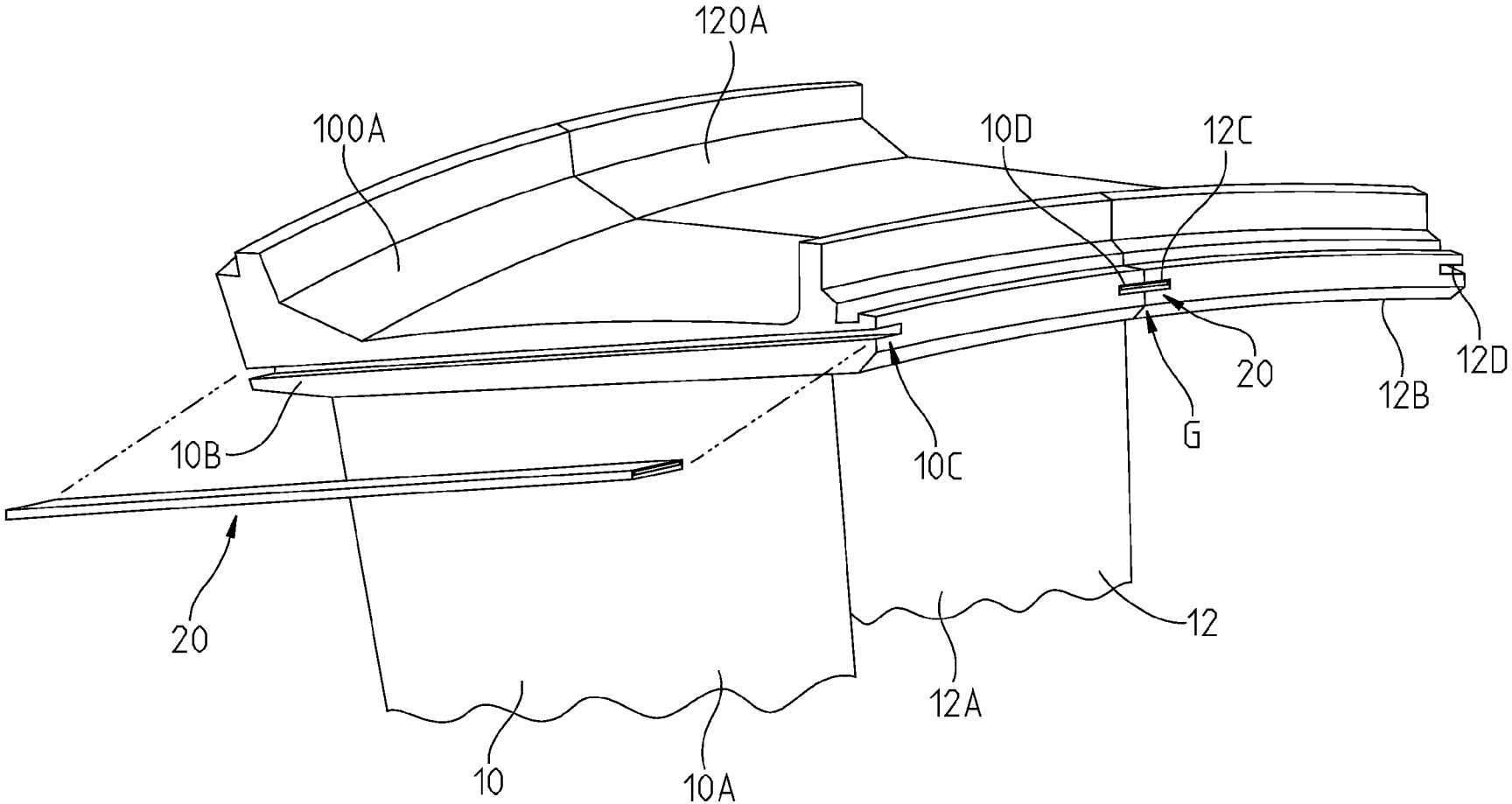
FIG. 1 is a perspective view of first and second vanes with a seal structure constructed in accordance with the present invention.

FIG. 1 illustrates first and second turbine engine components comprising first and second adjacent stationary vanes 10 and 12. The first vane 10 comprises a first airfoil 10A and a first platform 10B. The second vane 12 comprises a second airfoil 12A and a second platform 12B. The vane airfoils 10A and 12A function to guide hot combustion gases to rotatable blades (not shown) coupled to a rotor to effect rotation of the rotor. As is apparent from FIGS. 1 and 2, the first and second vane platforms 10B and 12B are positioned adjacent to one another.

In accordance with a first embodiment of the present invention, a seal structure 20 is provided between the adjacent first and second vane platforms 10B and 12B to seal a gap G between the first and second platforms 10B and 12B, see FIGS. 1-4. The first platform 10A is provided with first and second circumferentially spaced apart slots 10C and 10D and the second platform 12B is provided with third and fourth circumferentially spaced apart slots 12C and 12D. The second and third slots 10D and 12C are adjacent to one another and are open to the gap G, see FIGS. 1 and 2. The seal structure 20 fits into the second and third slots 10D and 12C and spans across the gap G so as to seal the gap G to prevent the hot working gases moving past the vane airfoils 10B and 12B from passing through the gap G. The seal structure 20 also prevents cooling gases or air exposed to lower surfaces 100A and 120A of the platforms 10B and 12B from passing through gap G.

It is also contemplated that the seal structure 20 may be used to seal gaps between other turbine engine components such as blades and ring segments (not shown).

The first and second vanes 10 and 12 may be formed from a metal alloy via a casting operation. The first, second, third and fourth slots 10C, 10D, 12C and 12D in the vane platforms 10B and 12B may be formed via a conventional electro-discharge machining (also referred to as electric discharge machining) operation. The second slot 10D is defined by first and second inner surfaces 100C and 100D in the first vane platform 10A and the third slot 12C is defined by third and fourth inner surfaces 120C and 120D in the second vane platform 12B, see FIG. 2. The first, second, third and fourth inner surfaces 100C, 100D, 120C and 120D of the first and second vane platforms 10B and 12B, because they are formed via an electro-discharge machining operation, have irregular surfaces $S_I$ or non-smooth topologies, see FIG. 3, which is an enlarged schematic view of portions of the third and fourth surfaces 120C and 120D in the second vane platform 12A. The inner surfaces 100C, 100D, 120C and 120D my have a surface roughness Ra falling within a range of from about 0.8 micrometer to about 12.5 micrometers.

Figure 2:
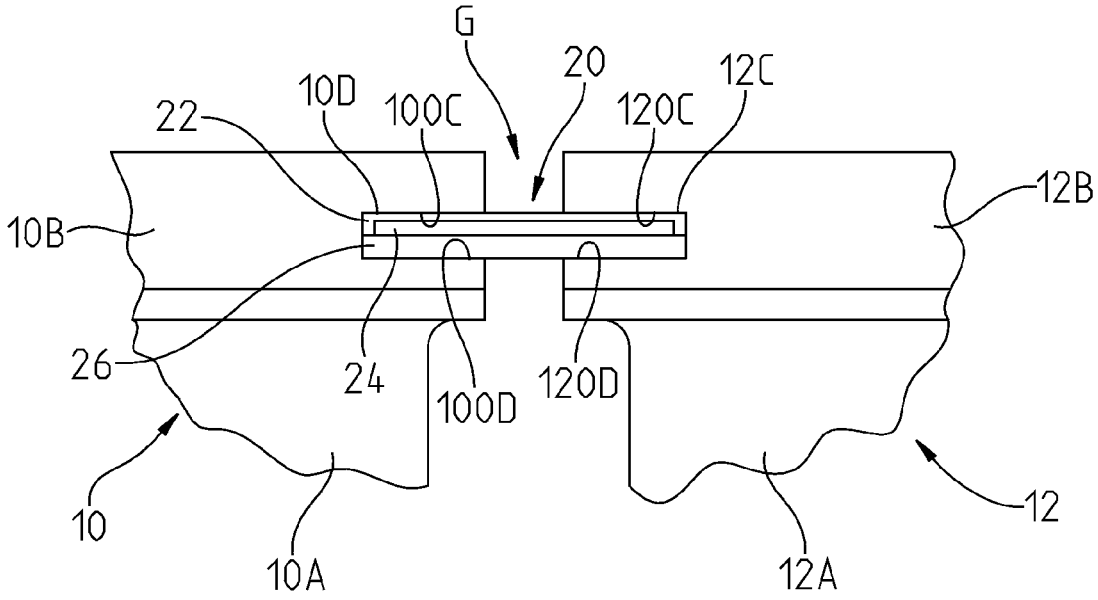
FIG. 2 is an enlarged view of a portion of the first and second vanes and the seal structure illustrated in FIG. 1.
Figure 3:
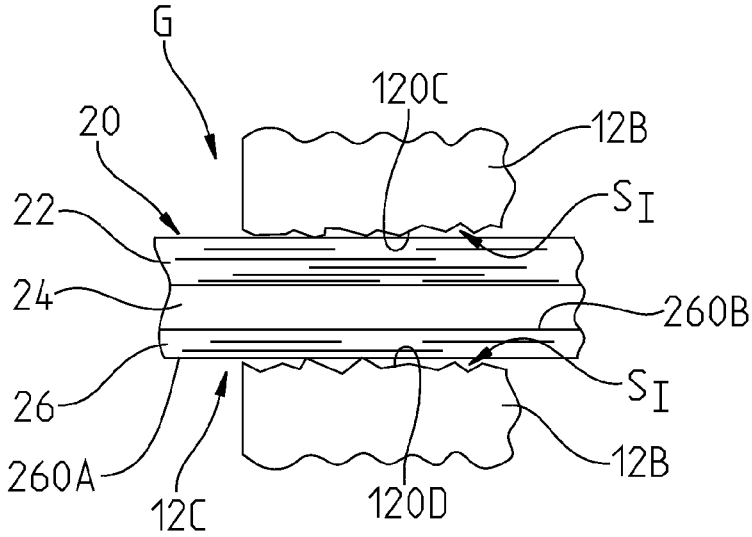
FIG. 3 is an enlarged view of a recess provided in the second vane with a seal structure constructed in accordance with a first embodiment of the present invention just after it has been inserted into the recess.
Figure 4:
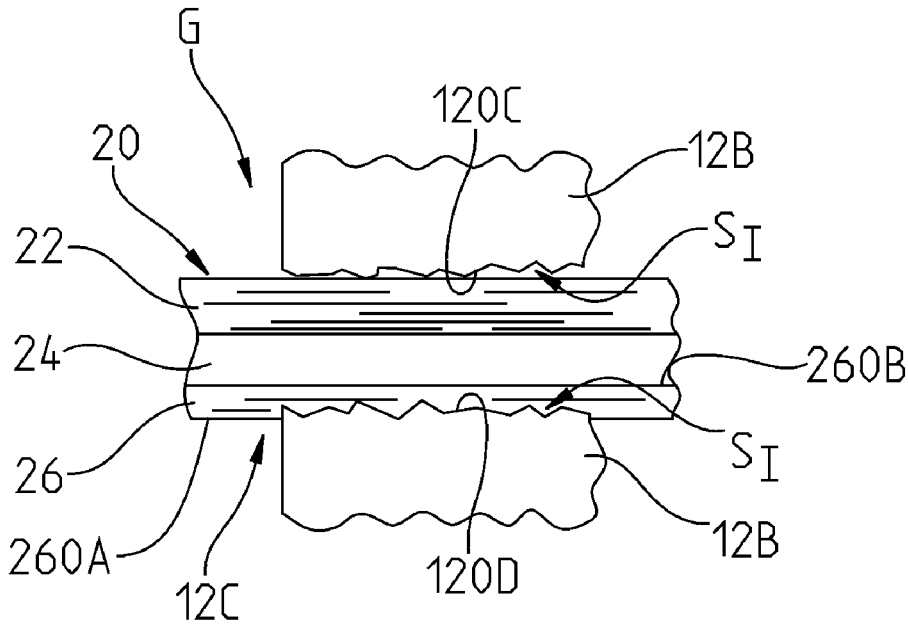
FIG. 4 is a view similar to FIG. 3, but after the seal has been in the recess for some period of time.

In a first embodiment illustrated in FIGS. 2-4, the seal structure 20 comprises a wear resistant layer 22, a core layer 24 and a deformable layer 26, wherein the core layer 24 is positioned between the wear resistant layer 22 and the deformable layer 26. In the illustrated embodiment, the wear resistant layer 22 is positioned adjacent to the first and third surfaces 100C and 120C of the first and second vane platforms 10B and 12B. Hence, the wear resistant layer 22 is exposed to cooling gases, which cooling gases also contact the lower surfaces 100A and 120A of the platforms 10B and 12B, as noted above. Since the wear resistant layer 22 is preferably harder than the first and third surfaces 100C and 120C of the first and second vane platforms 1013 and 12B, the wear resistant layer 22 will experience minimal wear during turbine engine operation.

The wear resistant layer 22 may be formed via a conventional laser cladding operation from one of a metal powder, e.g., nickel alloys, and a ceramic powder. Such a laser cladding operation may involve injecting a metal or ceramic powder towards a laser beam, such that the laser beam melts the powder, which melted powder is then deposited onto a substrate, i.e., the core layer 24. Preferably, the wear resistant layer 22 is slightly harder than the first and second vane platforms 10B and 12B. Hardness of the wear resistant layer 22 can be defined by selecting a metal powder or ceramic powder having a desired hardness, which, preferably, exceeds that of the first and second vane platforms 10B and 12B.

The core layer 24 may be formed from a metal such as a Nickel or Cobalt based Alloy and functions to provide load carrying strength and/or provide a spring function to the seal structure 20.

In the illustrated embodiment, the deformable layer 26 is positioned adjacent to the second and fourth surfaces 100D and 120D of the first and second vane platforms 10B and 12B. Hence, the deformable layer 26 is exposed to the hot working gases, which hot gases also contact the airfoils 10A and 12A, as noted above. The deformable layer 26 may also be formed via a conventional laser cladding operation from one of a metal powder, e.g., nickel alloys, and a ceramic powder. Preferably, the deformable layer 26 is softer, i.e., less hard, than the first and second vane platforms 10B and 12B. Softness/hardness of the deformable layer 26 can be selected based on the softness/hardness of the metal powder or ceramic powder used in forming the deformable layer 26. Softness/hardness can also be varied based on the density of the deformable layer 26, which density can be varied with metal or ceramic powder feed rate as well as by selecting an appropriate laser power. For example, as laser power is decreased, the resulting layer may comprise less densely packed powder particles with more voids between the powder particles, thereby resulting in a less hard and/or more deformable layer 26. Softness/hardness can further be varied based on porosity of the deformable layer 26, which porosity can be varied based on metal or ceramic powder particle size and/or laser power. For example, as laser power is decreased, the resulting layer may comprise less densely packed powder particles with more voids between the powder particles.

Preferably, the deformable layer 26 includes an outer surface 260A, near the second and fourth surfaces 100D and 120D of the first and second vane platforms 10B and 12B, and an inner surface 260B, adjacent the core layer 24, see FIG. 3. The deformable layer 26 preferably comprises a density which increases gradually from the outer surface 260A to the inner surface 260B. Alternatively, the deformable layer 26 may comprise a porosity which decreases gradually from the outer surface 260A to the inner surface 260B. FIG. 3 schematically illustrates the seal structure 20 just after it is first inserted into the second and third slots 10D and 12C in the vane platforms 10B and 12B.

During operation of the engine turbine, the cooling gases have a greater pressure than that of the hot working gases. Hence, the cooling gases apply a force on the wear resistant layer 22 so as to force the deformable layer 26 against the second and fourth surfaces 100D and 120D of the first and second vane platforms 10B and 12B. Hence, the deformable layer 26 may permanently deform, i.e., powder or metal particles of the deformable layer 26 may break off from adjacent particles, such that the layer 26 corresponds in shape to the surface imperfections on the second and fourth surfaces 100D and 120D of the first and second vane platforms 10B and 12B. Because the deformable layer 26 conforms to the irregular surfaces $S_I$ of the second and fourth surfaces 100D and 120D, an enhanced seal is made between the seal structure 20 and the second and fourth surfaces 100D and 120D of the first and second vane platforms 10B and 12B so as to limit or minimize leakage of hot working gases and/or cooling gases through the gap G.

Figure 5:
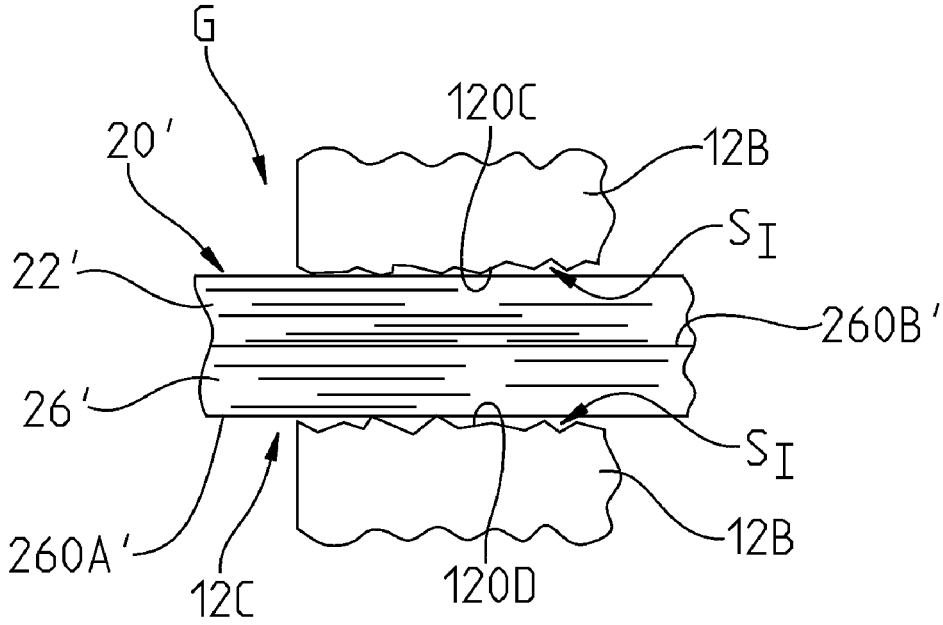
FIG. 5 is an enlarged view of a recess provided in the second vane with a seal structure constructed in accordance with a second embodiment of the present invention just after it has been inserted into the recess.

In a second embodiment illustrated in FIG. 5, the seal structure 20' comprises a wear resistant layer 22' and a deformable layer 26'. No metal core layer is provided in this embodiment. The wear resistant and deformable layers 22' and 26' may be formed in the same manner as the wear resistant and deformable layers 22 and 26 illustrated in FIGS. 3 and 4. During operation of the engine turbine, the cooling gases apply a force on the wear resistant layer 22' so as to force the deformable layer 26' against the second and fourth surfaces 100D and 120D of the first and second vane platforms 10B and 12B. Hence, the deformable layer 26' may permanently deform, i.e., powder or metal particles of the deformable layer 26' may break off from adjacent particles, such that the layer 26' corresponds in shape to the surface imperfections on the second and fourth surfaces 100D and 120D of the first and second vane platforms 10B and 12B. Because the deformable layer 26' conforms to the irregular surfaces $S_I$ of the second and fourth surfaces 100D and 120D, an enhanced seal is made between the seal structure 20' and the second and fourth surfaces 100D and 120D of the first and second vane platforms 10B and 12B so as to limit or minimize leakage of hot working gases and/or cooling gases through the gap G.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A seal structure for preventing leakage of gases across a gap between first and second components in a turbine engine, said seal structure being adapted to be received in first and second slots provided in the first and second components, said seal structure comprising:

a wear resistant layer; and a deformable layer formed from one of a metal powder and a ceramic powder, said deformable layer being softer than the first and second turbine engine components.

2. The seal structure as set out in claim 1, further comprising a core layer positioned between said wear resistant layer and said deformable layer.

3. The seal structure as set out in claim 2, wherein said core layer comprises a metal core layer.

4. The seal structure as set out in claim 1, wherein said wear resistant layer is harder than the first and second turbine engine components.

5. The seal structure as set out in claim 1, wherein said deformable layer includes an outer surface and an inner surface and comprises a density which increases from said outer surface to said inner surface.

6. The seal structure as set out in claim 1, wherein said deformable layer includes an outer surface and an inner surface and comprises a porosity which decreases from said outer surface to said inner surface.

7. The seal structure as set out in claim 1, wherein said deformable layer is defined by a material having one of a varying density and a varying porosity.

8. A turbine engine comprising:

a first component having a first slot;

a second component having a second slot, wherein said second component is positioned adjacent to said first component such that said first and second slots are positioned generally opposed to one another;

a seal structure provided in said first and second slots for preventing leakage of gases across a gap between said first and second components, said seal structure comprising:

a wear resistant layer; and a deformable layer formed from one of a metal powder and a ceramic powder, said deformable layer being softer than said first and second components.

9. The turbine engine as set out in claim 8, further comprising a core layer positioned between said wear resistant layer and said deformable layer.

10. The turbine engine as set out in claim 9, wherein said core layer comprises a metal core layer.

11. The turbine engine as set out in claim 8, wherein said wear resistant layer is harder than said first and second components.

12. The turbine engine as set out in claim 8, wherein said deformable layer includes an outer surface and an inner surface and comprises at least one of:

a density which increases from said outer surface to said inner surface; and a porosity which decreases from said outer surface to said inner surface.

13. The turbine engine as set out in claim 12, wherein said first slot is defined by first and second inner surfaces of said first component and said second slot is defined by third and fourth inner surfaces of said second component, said second and fourth inner surfaces having surface imperfections.

14. The turbine engine as set out in claim 13, wherein said second and fourth surfaces have a surface roughness Ra falling within a range of from about 0.8 micrometers to about 12.5 micrometers.

15. The turbine engine as set out in claim 13, wherein said outer surface of said deformable layer contacts said second and fourth inner surfaces of said first and second components and permanently deforms during operation of said engine so as to correspond in shape to the surface imperfections on said second and fourth inner surfaces.

16. The turbine engine as set out in claim 15, wherein said outer surface of said deformable layer is exposed to hot working gases and said wear resistant layer is exposed to cooling gases, said cooling gases having a pressure greater than that of said hot working gases.

17. The turbine engine as set out in claim 8, wherein said deformable layer is defined by a material having one of a varying density and a varying porosity.

* * * * *